US006179093B1

(12) United States Patent
Daugherty, Jr.

(10) Patent No.: US 6,179,093 B1
(45) Date of Patent: Jan. 30, 2001

(54) POWER SOURCE ACTIVATED HANDBRAKE RELEASE MECHANISM

(75) Inventor: David W. Daugherty, Jr., Plainfield, IL (US)

(73) Assignee: Westinghouse Air Brake Company, Wilmerding, PA (US)

( * ) Notice: Under 35 U.S.C. 154(b), the term of this patent shall be extended for 0 days.

(21) Appl. No.: 09/157,282

(22) Filed: Sep. 18, 1998

(51) Int. Cl.[7] ..... B61H 13/00

(52) U.S. Cl. ..... 188/33; 188/153 R; 188/107; 74/89

(58) Field of Search ..... 188/33, 153 R, 188/107, 170, 106 F, 216; 303/13, 89, 71, 14, 15, 66, 81; 74/89, 89.1, 89.11, 148, 504, 89.21, 89.22

(56) References Cited

U.S. PATENT DOCUMENTS

| | | | | |
|---|---|---|---|---|
| 2,940,553 | * | 6/1960 | Newell et al. | 188/153 R |
| 2,940,554 | * | 6/1960 | Cameron | 188/153 R |
| 4,978,178 | * | 12/1990 | Engle | 188/107 X |
| 5,201,890 | * | 4/1993 | Sauer et al. | 188/107 |
| 5,558,411 | * | 9/1996 | Kanjo et al. | 188/170 X |

* cited by examiner

*Primary Examiner*—Michael Mar
*Assistant Examiner*—Melanie Talavera
(74) *Attorney, Agent, or Firm*—James Ray & Associates

(57) ABSTRACT

A power source activated handbrake release mechanism for automatically releasing a parking brake assembly for a railroad vehicle braking system is provided. The power source activated handbrake release mechanism includes a hydraulically or pneumatically activated piston assembly including a piston rod mounted for movement upon activation of a piston within the piston assembly. An elongated member is associated at one end with this piston rod such that it moves laterally with respect to a bottom surface of the piston rod upon vertical movement of this piston rod. Another end of the elongated member is secured with the release shaft of the handbrake such that the lateral movement of the elongated member results in a rotational force being applied to the release shaft causing the automatic release of the handbrake. A system is also provided which allows the quick release handle of the handbrake to remain stationary during application of a rotational force to the release shaft via the power source activated handbrake release mechanism of the invention while maintaining the ability for an operator to manually release the handbrake with this handle should a power source be unavailable.

23 Claims, 5 Drawing Sheets

POWER SOURCE ACTIVATED HANDBRAKE RELEASE MECHANISM

FIELD OF THE INVENTION

The present invention relates, in general, to a handbrake release mechanism for a parking brake assembly for a railway vehicle braking system and, more particularly, to a power source activated handbrake release mechanism for a parking brake assembly for a railroad vehicle braking system.

BACKGROUND OF THE INVENTION

As is generally well known in the railway industry, when railway cars are taken out of a train and parked at a siding or yard, the handbrake or parking brake on at least some of these cars is applied as a precaution against unwanted or unexpected movement of the cars. A typical railway car hand brake system normally consists of an apparatus for manually applying and biasing one or more brake shoes against the tread of one or more wheels of the railway car by either turning a hand wheel or pumping a ratchet handle on a hand brake mechanism attached to the railway car.

As illustrated in FIGS. 7–9, the hand brake mechanism is usually either a cast or stamped metal gear housing/back plate assembly usually attached to an outside end wall of the railway car and having a rotatable chain drum therein which can be rotated by turning the hand wheel, typically in a clockwise direction. This rotation is transmitted directly through a drive shaft, a pinion, a gear and a chain drum to wind a brake chain onto the chain drum. The other end of the brake chain normally extends through the bottom of the gear housing and is interconnected with cable or other linkage to the brake rigging (not shown) so as to draw the interconnected brake shoes against the tread surfaces of adjacent railway car wheels and, accordingly, apply the hand brake as intended.

When resistance is offered by the chain to further rotation of the hand wheel, such resistance, acting back through the drum, the gear and pinion, causes a nut to move against a ratchet member which is clamped between respective friction surfaces on the nut and on the drive shaft, thus causing the drive shaft, ratchet and the nut to rotate as a unit. A pawl prevents rotation of the ratchet in the opposite direction.

A gradual release of the brakes may be performed by rotating the hand wheel in an opposite direction, such as in a counterclockwise direction, which partially loosens the nut to reduce the clamping force on the ratchet. This action allows the pinion and gear to rotate to reduce chain load and release the brakes.

Although turning the hand wheel in the opposite direction may operate to release the handbrake in proportion to the extent of such turning, some ratchet member and pawl systems may not permit turning the hand wheel in the opposite direction. Accordingly, most handbrake mechanisms are provided with a quick release, non-spin mechanism which functions to instantly and completely release the handbrake without causing the hand wheel or ratchet member to spin. The quick release mechanism is normally actuated by pivoting a handbrake release handle, the handbrake release handle being attached to a brake release shaft, which, when rotated by the hand brake release handle outside of the gear housing, will disengage the chain drum and lock it in place, thereby permitting the chain to self unwind from the chain drum. Normally, the outer end of the brake release shaft is provided with a tight-fitting lever arm type of handbrake release handle so that to release the handbrake, the handle or lever arm is merely pushed upwardly to rotate the brake release shaft (normally clockwise) as necessary to completely release the handbrake.

Whether the handbrake is released via counterclockwise rotation of the hand wheel or by pushing up the quick release lever, both techniques require an operator to climb on and off each car to manually activate this brake release. This can be a time-consuming, as well as, expensive procedure to perform.

SUMMARY OF THE INVENTION

It is an object of the invention to provide an automatic handbrake release mechanism for a parking brake assembly for a railway vehicle braking system.

It is yet a further object of the invention to provide an automatic, power activated handbrake release mechanism for a parking brake assembly which allows for a quick, inexpensive release of the brakes on each of or a selected number of cars on a railway vehicle. The automatic handbrake release mechanism of the invention eliminates the need for train personnel to climb on and off each of the railway cars to manually release the brakes.

It is yet another object of the invention to design the quick release handle mounting system of the handbrake such that this handle does not rotate upon activation of the automatic handbrake release mechanism of the invention yet allows for a manual activation of the handle in situations where a power source is not available to release the brakes.

It is another object of the invention to design the handbrake such that the quick release handle remains stationary during rotation of the release shaft via the automatic handbrake release mechanism of the invention.

It is yet a further object of the invention to include a means associated with the quick release handle to enable manual release of the handbrake via the quick release handle during situations where a power source is unavailable to actuate the automatic handbrake release mechanism of the invention.

The power activated automatic handbrake release mechanism of the invention comprises a piston assembly engagable with said the railway vehicle handbrake. This piston assembly includes a piston arrangement having a piston rod attached thereto. This piston rod is mounted for movement outward from the piston assembly upon activation of a piston in the piston arrangement. An elongated member having a first end and a second end is provided. The first end of this elongated member is associated with the piston rod at a location remote from said piston assembly such that the elongated member is capable of movement with respect to movement of the piston rod. A release shaft is engageable with the second end of the elongated member such that activation of the piston of the piston assembly causes activation of this release shaft to automatically release the railway vehicle handbrake. The first end of the elongated member is associated with a bottom surface of the piston rod such that this first end can move in a lateral direction upon vertical movement of the piston rod. This lateral movement of the piston rod causes a rotational force to be applied to the release shaft which causes the handbrake to release.

The manually actuated quick release handle assembly for a railway vehicle handbrake having the power actuated handbrake release mechanism of the invention comprises a handle associated with the release shaft which remains stationary during rotational movement of the release shaft upon actuation of the power actuated handbrake release mechanism, a pie shaped opening positioned in the release shaft itself or a circular plate member which is engagable with and capable of rotating the release shaft, and an engaging means engagable with the quick release handle and extending into the pie shaped opening such that a manual movement of the quick release handle to an applied position causes this engaging means to apply a rotational force to the release shaft to cause a manual release of the railway vehicle handbrake.

DETAILED DESCRIPTION OF THE INVENTION

Figure 1:
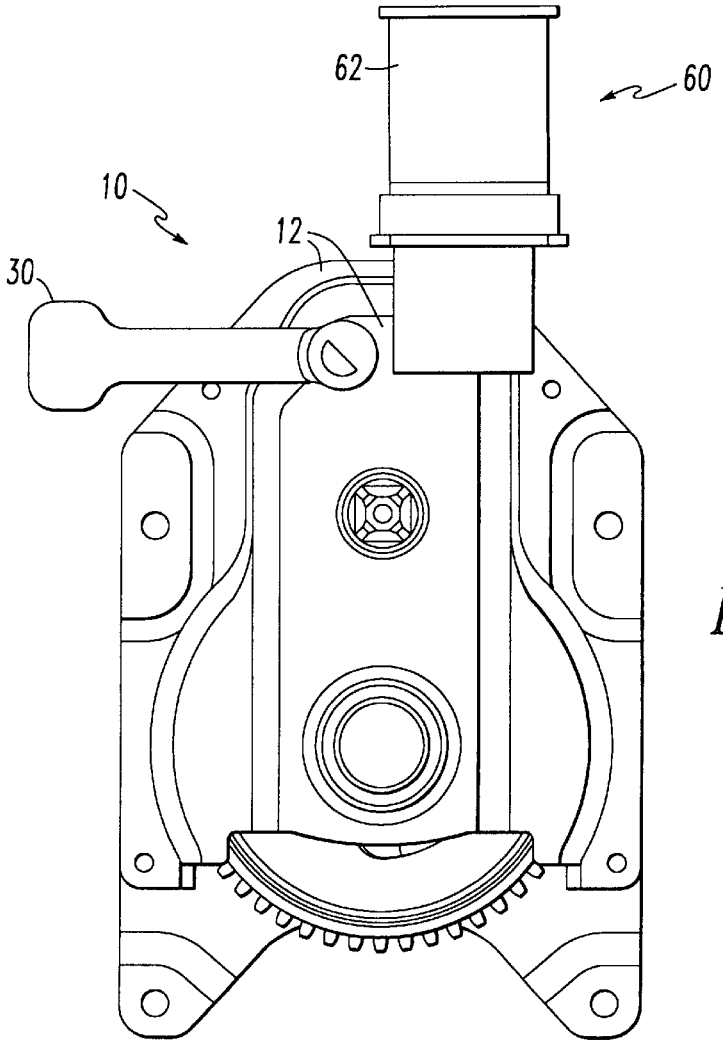
FIG. 1 is frontal view of a handbrake device having the power activated handbrake release mechanism of the invention.
Figure 4:
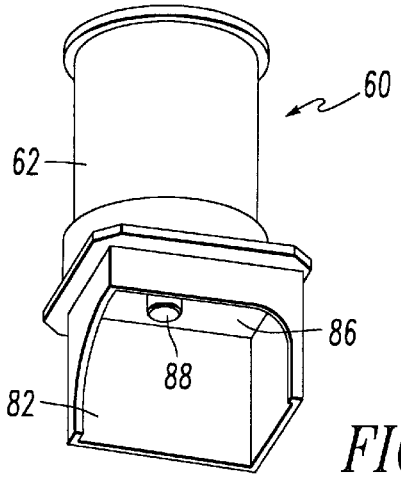
FIG. 4 is an overall view of the handbrake release mechanism of the invention.

Prior to proceeding with the more detailed description of the present invention, a description of manually activated quick release mechanisms for railway vehicle handbrakes should prove helpful in understanding the present invention. Also, it should be noted that for the sake of clarity, identical components which have identical functions have been identified with identical reference numerals throughout the several views illustrated in the attached drawing figures.

Figure 8:
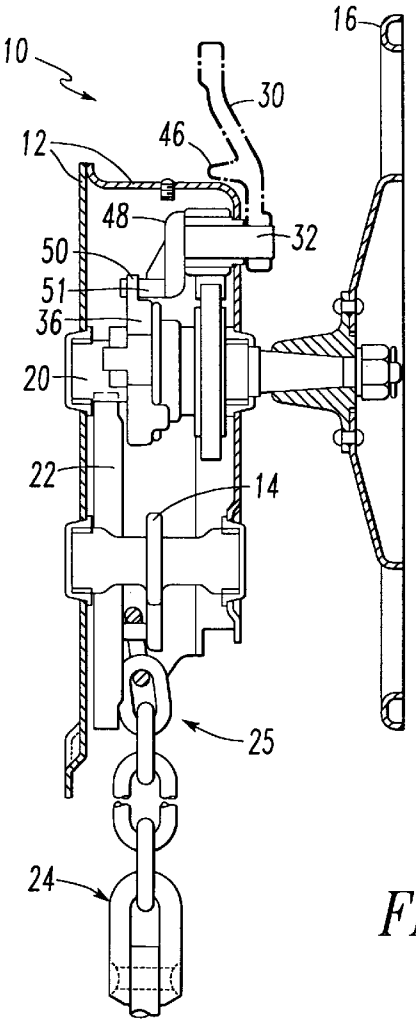
FIG. 8 is an elevation view, in section, taken along the line VIII—VIII of FIG. 7 as viewed in the direction indicated by the arrows.
Figure 7:
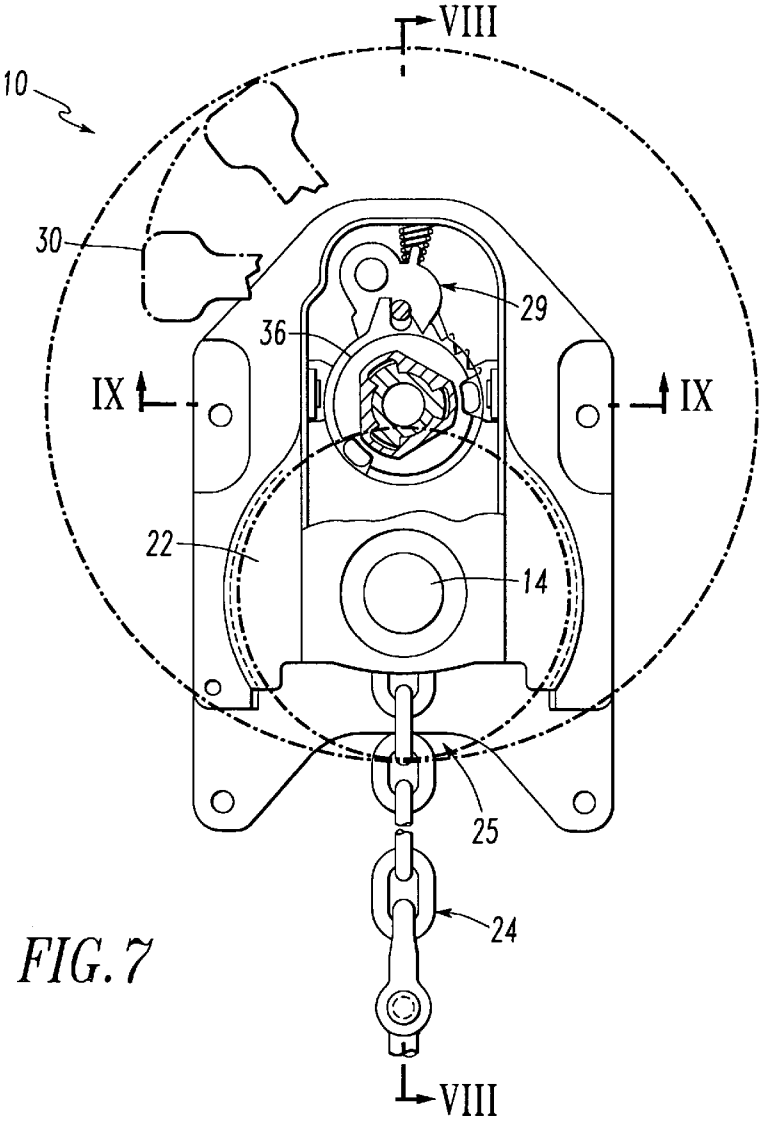
FIG. 7 is an elevation frontal view, partly in section, of a typical handbrake device without the power activated handbrake release mechanism of the invention.
Figure 9:
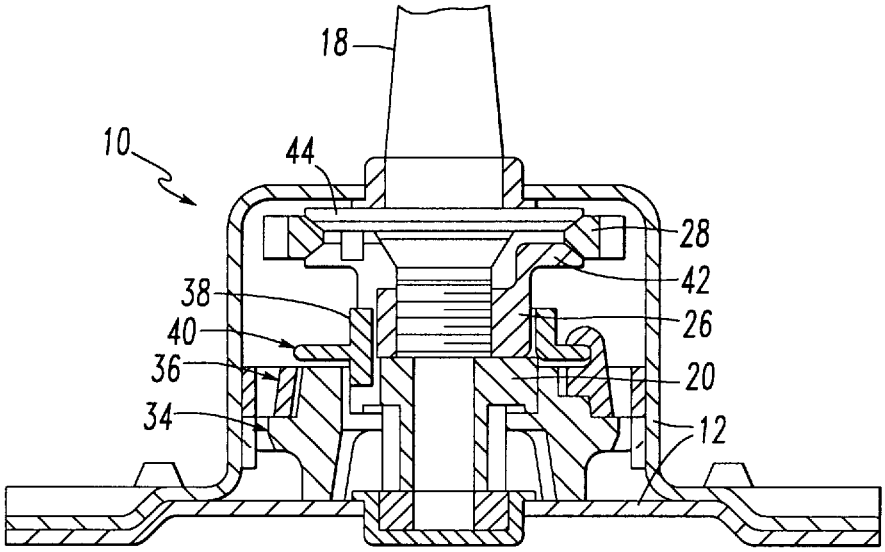
FIG. 9 is a section view taken along line IX—IX of FIG. 7 as viewed in the direction indicated by the arrows.

Referring to FIGS. 7–9, there is shown a railway vehicle handbrake, generally designated 10, for a railway vehicle (not shown). Disposed in the upper portion of the housing 12 is a clutch and quick release mechanism which may best be seen in FIG. 9. The clutch and release mechanism comprises an annular stationary cam member 34 and an annular movable cam member 36 which is rotatable with respect to the stationary cam member 34. An internally splined clutch collar 38 is provided with an annular flange 40 and concentrically surrounds the drive shaft 18, the collar 38 engages with an externally splined nut 26 screwable on a screw-threaded portion of the shaft 18. The nut 26 has a flange 42 with an annular friction surface for making abutting contact with one side of a ratchet wheel 28, the other side of the ratchet wheel 28 being abuttable with a friction surface of a friction plate 44 concentrically secured to the shaft 18.

A release shaft 32 is journaled in a release shaft bushing perpendicularly secured in the housing 12 above the driving mechanism, as viewed in FIG. 8. A release handle 30 is secured to an external end of release shaft 32 while the other end of the release shaft is provided with a release shaft flange 48, thereby preventing axial displacement of the shaft. A release handle lug 46 fixed on release handle 30 and a housing side wall limit counterclockwise rotation of release handle 30, while release shaft flange 48 and a housing side wall limit clockwise rotation of release shaft 30 to insure positive linkage between the release shaft 32 and a movable cam fork 50 through a pin 51 formed on the shaft 32 and engageable with the fork 50.

A quick release of the brake application is effected by manually rotating release handle 30 (which is normally in an applied position) in a clockwise direction, as viewed in FIG. 7, to a release position which, by engagement of pin 51 with fork 50 of movable cam 36, causes counterclockwise rotation of the movable cam 36. As movable cam 36 rotates counterclockwise, it moves axially outwardly with respect to the stationary cam 34, in an upwardly direction as viewed in FIG. 9, and carries with it clutch collar 38 by engagement of flange 40 thereof. This upward axial movement of the movable cam 36 causes axial disengagement of the clutch collar 38 from the pinion 20, thereby allowing the pinion 20 and gear 22 to rotate freely for releasing the load on chain 24, while drive shaft 18, nut 26, and ratchet 28 are all held stationary by holding pawl 29.

The power source activated handbrake release mechanism of the present invention, as illustrated in FIGS. 1–6, automatically causes the above described quick release, non-spinning operation to occur by applying a rotational force to the release shaft 32, eliminating the need for an operator to manually rotate the release handle 30 to perform this operation. This handbrake mechanism comprises a piston assembly, generally designated as 60, engagable with the railway vehicle handbrake 10.

This piston assembly 60 may be hydraulically or pneumatically activated. The piston assembly 60 comprises a cylindrical housing 62 for housing a piston arrangement, generally designated as 64, a piston rod 66 for movement outward from the piston assembly 60 upon activation of the piston arrangement 64 and a spring 68 for returning the piston arrangement 64 and piston rod 66 to their original position upon deactivation of the piston arrangement 64. The piston arrangement 64 includes a piston 70, a packing cup 72, a piston guide 74, alongwith a guide ring 76. The piston rod 66 may be secured to the piston arrangement 64 by any well known means, such as for example, a hex head bolt/washer assembly 78,79. The housing includes a top wall 80. The hex head bolt 78 can function as a stop means against the inner surface 82 of this housing top wall 80 upon deactivation of the piston 70.

Figure 6:
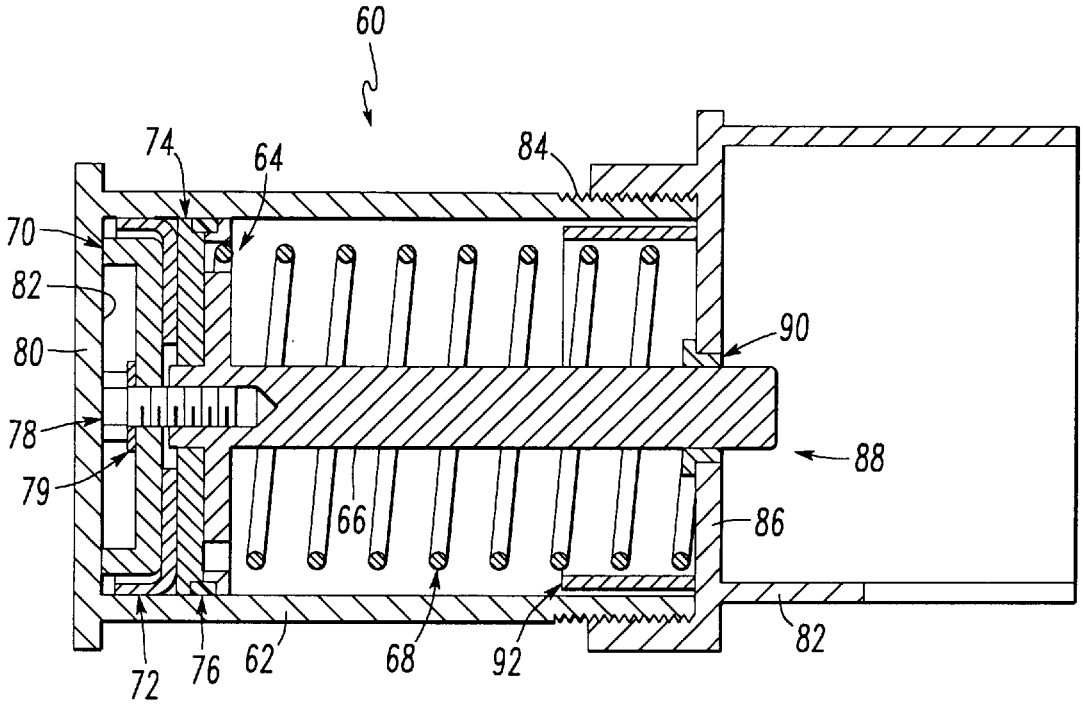
FIG. 6 is a cross-sectional view along line VI—VI of FIG. 5 as viewed in the direction indicated by the arrows.

The piston assembly 60 is engageable with the vehicle handbrake housing 12 by any well known means such as for example with a cylinder mounting bracket 83 which is secured to an outer surface 84 of the cylindrical piston housing 62. This bracket includes a wall 86 which abuts an end portion of the cylindrical housing 62 and an aperture 88 is provided through this wall from which the piston rod 66 extends and retracts, with the aid of a bearing 90, upon activation and deactivation of the piston 70. Although FIG. 6 shows the wall through which the piston rod 66 extends as being a component of the bracket 83, it is well known in the art that a bottom wall may by provided on the cylindrical housing 62 of the piston assembly 60 itself and the piston rod 66 can extend through an aperture in such a wall. Also included within the housing is a sleeve 92 which surrounds a bottom portion of the return spring 68.

Figure 3:
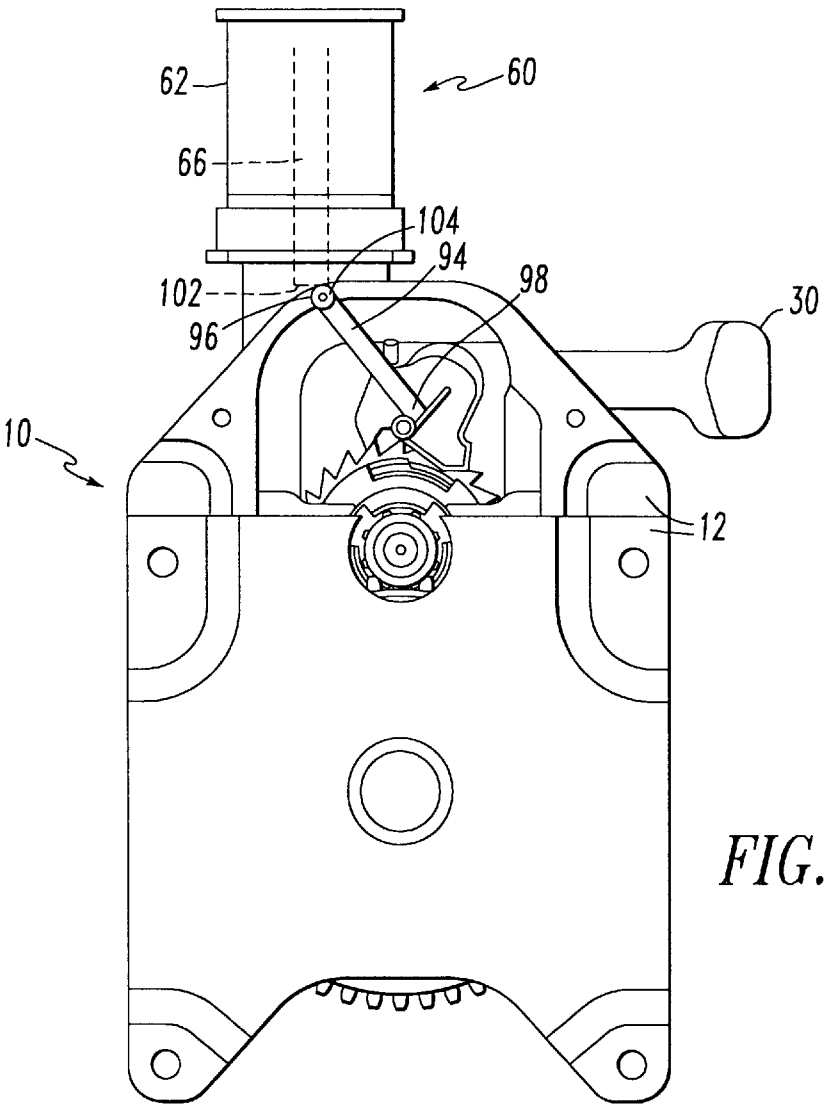
FIG. 3 is a back view of a handbrake device having the power activated handbrake release mechanism of the invention showing the engagement of the elongated member with the piston rod of the piston and assembly and with the release shaft of the handbrake.
Figure 2:
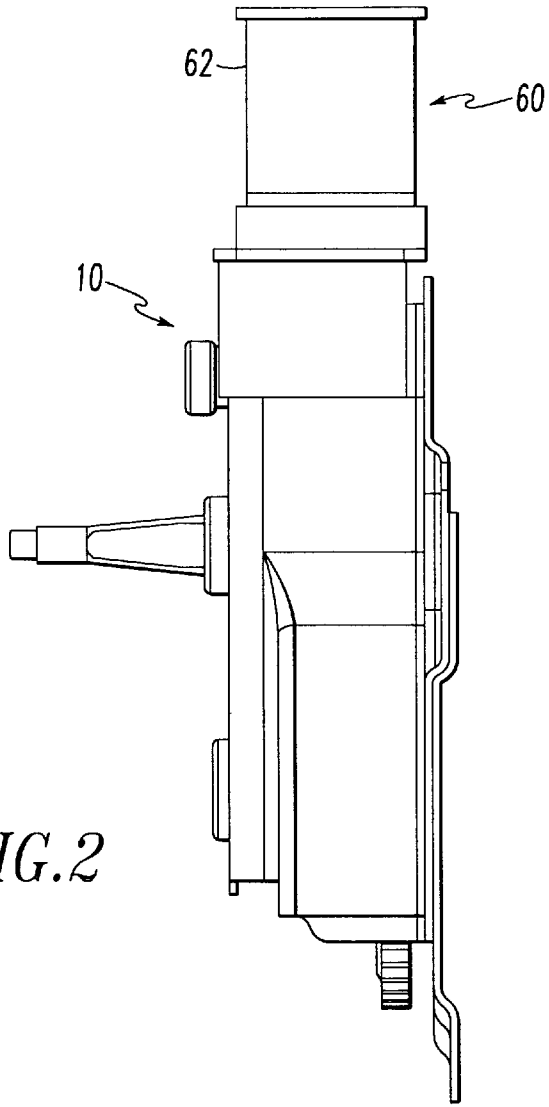
FIG. 2 is a side view of a handbrake device having the power activated handbrake release mechanism of the invention.
Figure 5:
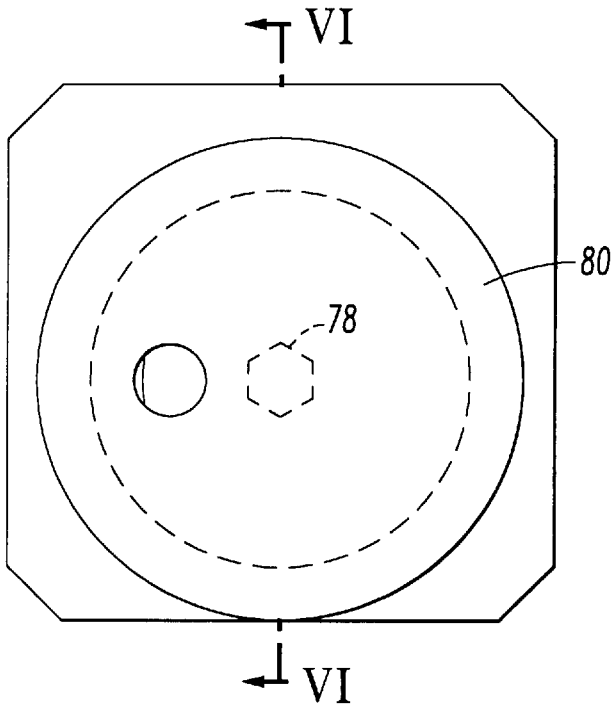
FIG. 5 is a top view of the handbrake release mechanism of the invention.

An elongated member 94, as shown in FIG. 3, having a first end 96 and a second end 98 is provided. The first end 96 of this elongated member 94 is associated with the piston rod 66 at a location which is remote from the piston assembly i.e. the portion of the piston rod 66 which extends through the aperture 88. This elongated member 94 is capable of lateral movement along a bottom surface 102 of the piston rod 66 with respect to vertical movement of the piston rod 66. This lateral movement may be facilitated by the provision of a roller 104 or a cam surface (not shown) at the first end 96 of the elongated member 94 or alternatively a roller or cam surface at a bottom end of the piston rod 66.

The second end 98 of the elongated member 94 is engageable with the release shaft 32 of the handbrake 10. This second end 98 may be engaged with the release shaft 32 by any well known means such as with a separate mechanical joining means, forged or welded thereto, cast as a single component therewith, and the like. The elongated member 94 and the release shaft 32 are engaged in a manner such that activation of the piston 70 or piston arrangement 64 of the piston assembly 60 causes vertical movement of the piston rod 66 which, in turn causes lateral movement of the elongated member 94 and consequently applies a lateral or rotational force to the release shaft 32. This lateral or rotational force applied to the release shaft 32 causes the release shaft 32 to automatically move in a manner as if the quick release handle 30 had been manually rotated to the release position. Specifically, activation of the automatic handbrake release mechanism 60 of the invention causes counterclockwise rotation of the movable cam 36 such that this movable cam 36 moves axially outwardly with respect to the stationary cam 34, in an upwardly direction, carrying the clutch collar 38. This upward axial movement of the movable cam 36 causes axial disengagement of the clutch collar 38 from the pinion 20, thereby allowing the pinion 20 and gear 22 to rotate freely for releasing the load on chain 24, while drive shaft 18, nut 26, and ratchet 28 are all held stationary by holding pawl 29.

The power source activated handbrake release mechanism of the invention may be controlled by an electrically controlled valve which controls an amount of fluid supplied to the piston assembly 60. Any well known device capable of energizing a solenoid valve may be used for controlling this amount of fluid applied to the mechanism, such as for example, an electronic controlled pneumatic brake computer.

When utilizing the automatic handbrake release mechanism of the present invention, it is desirable to design the handbrake system such that the quick release handle 30 remains stationary or does not rotate when the release shaft 32 is rotated via the power operated automatic handbrake release mechanism. Unwanted and/or unexpected movement of this quick release handle 30 upon an automatic release of the handbrakes could be undesirable. Although it is desirable for the handle 30 to remain stationary with respect to rotation of the release shaft via the power operated release mechanism, the quick release system must be designed such that the quick release handle 30 can still be utilized to release the brakes in situations where a power source is not readily available to activate the automatic handbrake release mechanism of the invention.

Figure 10:
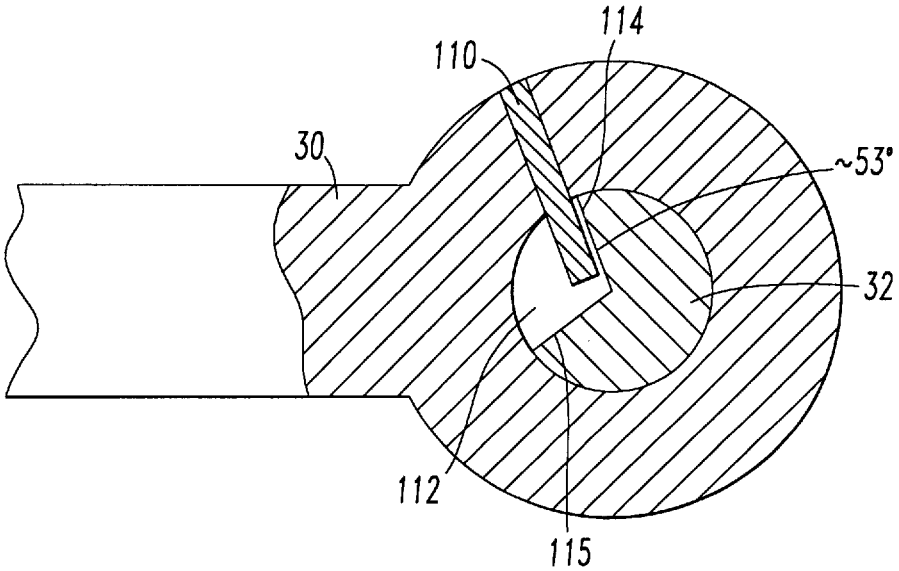
FIG. 10 is a schematic view illustrating a release handle arrangement enabling manual activation of the handbrake release mechanism.

FIG. 10 illustrates a design for allowing manual release of the brakes with the quick release handle 30. A pie shaped opening 112 is provided having first and second sidewalls 114, 115. This pie shaped opening can be provided within the release shaft 32 or within a separate circular plate member (not shown) which is engageable with the release shaft 32. The pie shaped opening has an angle of approximately 45–60°, preferably approximately 53°. An engaging means, such as a pin or lug member 110 is secured with the quick release handle 30. A portion of the engaging means 110 is placed within this pie shaped opening 112. Upon manual movement of the quick release handle 30 to an applied position, this engaging means 110 contacts the first sidewall 114 of the pie shaped opening and causes the release shaft to rotate so as to effect a manual release of the handbrake. Upon returning of the release handle 30 to its initial position, the engaging means 110 contacts the second sidewall 115 of the pie shaped opening to return the release shaft to an unapplied position. A cover member or cap (not shown) may be positioned over the pie shaped opening/pin arrangement.

The automatic handbrake release mechanism of the present invention provides an ergonomic alternative to prior art manually operated handbrake release mechanisms in that it eliminates the need for the operator to manually activate the brake release on each car. This manual activation can be a time-consuming and expensive procedure to perform.

Thus, the present invention has been described in such full, clear, concise and exact terms as to enable any person skilled in the art to which it pertains to make and use the same. It will be understood that variations, modifications, equivalents, and substitutions for components of the specifically described embodiments of the invention may be made by those skilled in the art without departing from the spirit and scope of the invention as set forth in the appended claims.

What is claimed is:

1. An automatic handbrake release mechanism for a railway vehicle handbrake, such railway vehicle handbrake including a housing and a movable cam located within such housing, said handbrake release mechanism comprising:

(a) a piston assembly engagable with such railway vehicle handbrake, said piston assembly including a piston rod for movement outward from said piston assembly upon activation of a piston in said piston assembly;

(b) an elongated member having a first end and a second end, said first end being associated with said piton rod at a location remote from said piston assembly such that said elongated member is capable of movement with respect to movement of said piston rod; and (c) a release shaft associated with such movable cam within such housing of such railway vehicle handbrake, said release shaft being engagable with said second end of said elongated member such that activation of said piston of said piston assembly causes lateral movement of said elongated member resulting in rotation of said release shaft and said movable cam to automatically release such railway vehicle handbrake.

2. An automatic handbrake release mechanism as recited in claim 1 wherein activation of said piston causes said release shaft to rotate in a clockwise direction to automatically release such railway vehicle handbrake.

3. An automatic handbrake release mechanism as recited in claim 1 wherein said first end of said elongated member includes a roller capable of lateral movement along a bottom surface of said piston rod upon vertical movement of said piston rod.

4. An automatic handbrake release mechanism as recited in claim 3 wherein lateral movement of said roller causes said elongated member to apply a lateral force to said release shaft causing said release shaft to rotate in a clockwise direction to automatically release such railway vehicle handbrake.

5. An automatic handbrake release mechanism as recited in claim 1 wherein said first end of said elongated member includes a cam surface which allows said elongated member to move in a lateral direction with respect to a bottom surface of said piston rod upon vertical movement of said piston rod.

6. An automatic handbrake release mechanism as recited in claim 5 wherein lateral movement of said elongated member causes a lateral force to be applied to said release shaft causing said release shaft to rotate in a clockwise direction to automatically release such railway vehicle handbrake.

7. An automatic handbrake release mechanism as recited in claim 1 wherein said piston assembly is fluid activated.

8. An automatic handbrake release mechanism as recited in claim 7 wherein said piston assembly is air activated.

9. An automatic handbrake release mechanism as recited in claim 7 wherein an electrically controlled valve is provided for controlling an amount of fluid supplied to said piston assembly.

10. An automatic handbrake release mechanism as recited in claim 8 wherein an electrically controlled valve is provided for controlling an amount of air supplied to said piston assembly.

11. An automatic handbrake release mechanism as recited in claim 10 wherein an electronic controlled computer is provided for controlling said electrically controlled valve.

12. An automatic handbrake release mechanism as recited in claim 1 including a quick release handle associated with said release shaft, said quick release handle capable of remaining stationary during activation of said release shaft by said automatic handbrake release mechanism.

13. An automatic handbrake release mechanism as recited in claim 12 including a pie shaped opening positioned in one of said release shaft and a circular plate member engagable with said release shaft, said pie shaped opening having a first and second sidewall and an engaging means engagable with said quick release handle, said engaging means capable of engaging said first sidewall of said pie shaped opening upon manual movement of said quick release handle to an applied position to apply a rotational force to said release shaft to cause a manual release of such railway vehicle handbrake.

14. An automatic handbrake release mechanism as recited in claim 13 wherein said engaging means are capable of engaging said second sidewall of said pie shaped opening upon movement of said quick release handle to an initial position.

15. An automatic handbrake release mechanism as recited in claim 13 wherein said engaging means comprises a pin secured on said quick release handle.

16. A manually actuated quick release handle assembly for a railway vehicle handbrake, such railway vehicle handbrake including a power actuated handbrake release mechanism for automatically releasing such handbrake, said quick release handle assembly comprising:

(a) a release shaft mounted within such railway vehicle handbrake, said release shaft being associated with such power actuated handbrake release mechanism and mounted for rotational movement upon actuation of such power actuated handbrake release mechanism for automatically releasing such handbrake;

(b) a quick release handle associated with said release shaft such that said quick release handle remains stationary during rotational movement of said release shaft upon actuation of such power actuated handbrake release mechanism;

(c) a pie shaped opening positioned in one of said release shaft and a circular plate member engagable with and capable of rotating said release shaft, said pie shaped opening having a first and second sidewall; and (d) an engaging means engagable with said quick release handle, said engaging means extending into said pie shaped opening and being capable of engaging said first sidewall of said pie shaped opening upon manual movement of said quick release handle to an applied position to apply a rotational force to said release shaft to cause a manual release of such railway vehicle handbrake.

17. A manually actuated quick release handle assembly as recited in claim 16 wherein said engaging means are capable of engaging said second sidewall of said pie shaped opening upon movement of said quick release handle to an initial position.

18. A manually actuated quick release handle assembly as recited in claim 16 wherein said pie shaped opening has an angle of approximately 45–60°.

19. A manually actuated quick release handle assembly as recited in claim 18 wherein said pie shaped opening has an angle of approximately 53°.

20. A manually actuated quick release handle assembly as recited in claim 16 wherein said engaging means comprises a pin secured on said quick release handle. reference character "83" is being used to designate the mounting bracket.

21. An automatic handbrake release mechanism for a railway vehicle handbrake, said handbrake release mechanism comprising:

(a) a piston assembly engagable with such railway vehicle handbrake, said piston assembly including a piston rod for movement outward from said piston assembly upon activation of a piston in said piston assembly;

(b) an elongated member having a first end and a second end, said first end being associated with said piton rod at a location remote from said piston assembly such that said elongated member is capable of movement with respect to movement of said piston rod;

(c) a release shaft engageable with said second end of said elongated member such that activation of said piston of said piston rod assembly causes activation of said release shaft to automatically release such railway vehicle handbrake;

(d) a quick release handle associated with said release shaft, said quick release handle capable of remaining stationary during activation of said release shaft by said automatic handbrake release mechanism; and (e) a pie shaped opening positioned in one of said release shaft and a circular plate member engageable with said release shaft, said pie shaped opening having a first and second sidewall and an engaging means engagable with said quick release handle, said engaging means capable of engaging said first sidewall of said pie shaped opening upon manual movement of said quick release handle to an applied position to apply a rotational force to said release shaft to cause a manual release of such railway vehicle handbrake.

22. An automatic handbrake release mechanism as recited in claim 21 wherein said engaging means are capable of engaging said second sidewall of said pie shaped opening upon movement of said quick release handle to an initial position.

23. An automatic handbrake release mechanism as recited in claim 21 wherein said engaging means comprises a pin secured on said quick release handle.

* * * * *